US005134906A

United States Patent [19]

Sit

[11] Patent Number: 5,134,906

[45] Date of Patent: Aug. 4, 1992

[54] CORK REMOVAL DEVICE

[76] Inventor: Howard A. Sit, 244 Citrus Ave., Daly City, Calif. 94014

[21] Appl. No.: 625,108

[22] Filed: Dec. 10, 1990

[51] Int. Cl.[5] ..... B67B 7/44

[52] U.S. Cl. ..... 81/3.09; 81/3.4

[58] Field of Search ..... 81/3.07, 3.09, 3.4, 81/3.41, 3.55

[56] References Cited

U.S. PATENT DOCUMENTS

| | | | |
|---|---|---|---|
| 47,161 | 4/1865 | Bielefield et al. | 81/3.07 |
| 72,247 | 12/1867 | Waterman | 81/3.07 |
| 140,706 | 7/1873 | Hunt | 81/3.07 |
| 777,380 | 12/1904 | Kennedy | 81/3.41 |
| 889,474 | 6/1908 | Medley | 81/3.07 |
| 983,778 | 2/1911 | Sersen | 81/3.07 |
| 4,679,467 | 7/1987 | Delnero | 81/3.4 |

*Primary Examiner*—Roscoe V. Parker

*Attorney, Agent, or Firm*—Janet Kaiser Castaneda

[57] ABSTRACT

A cork removal device having a handle, a conventional corkscrew device (such as a spiral corkscrew), and a strap for removal of damaged and pushed-through corks. The strap is made from a resilient plastic material and is attached to the handle forming a loop. In a folded position used to push a cork through the neck of a wine bottle, the middle area of the strap is folded inwardly and upwardly thereby forming a roughly "W" shaped configuration with pre-formed creases forming the bottom of the legs of the "W". The strap is unfolded for retrieval operations and inserted into the bottle, guided by the creases which contact the sides of the bottle neck. The buoyant cork moves into a saddle formed in the bottom of the strap and is removed with the strap when the user pulls upwardly. The strap is patterned so that cork fragments adhere to the strap. A storage cover is povided for placement over the folded strap, or the strap may be attached to and stored within the handle. The corkscrew pivots or swings out of the handle or the storage cover for normal cork removal operations. The strap may be removably attached to the handle and is therefore replaceable.

11 Claims, 5 Drawing Sheets

CORK REMOVAL DEVICE

FIELD OF THE INVENTION

A cork removal device is provided for corks that are used as stoppers for bottles containing liquids. The device finds particular application in removing a broken or damaged cork from the neck of a wine bottle and for retrieving a cork that has been pushed through the neck of a wine bottle.

BACKGROUND OF THE INVENTION

Corks are used as stoppers for a variety of bottles and containers. The corks are generally inserted into the opening of the neck of the bottle until the cork is flush with the top of the opening of the bottle.

Corkscrews have long been used to remove cork stoppers. In its simplest form, a corkscrew generally includes a spiral-shaped stainless steel element having a point at one end and a handle at the other end. The operator inserts the pointed end of the corkscrew into the cork and rotates the handle while applying force until the spiral-shaped element of the corkscrew has completely penetrated the cork. The operator then pulls upwardly on the handle while holding the bottle down to remove the cork.

The popularity of wine has spawned variations of the above described, basic corkscrew. One such variation, popularly known as the "Ah So" (TM), substitutes two thin, parallel flattened prongs for the basic spiral-shaped element. The pointed ends of the metallic prongs are positioned between the inside neck of the bottle and the cork and the "Ah So" is gently rocked back and forth with downwardly applied pressure until the two prongs have moved downwardly between the sides of the bottle and the cork. The user then twists the handle, while pulling upwardly, and the cork is thereby removed between the two prongs.

Other prior art corkscrews include pressurized devices designed to remove the corks with air or gas pressure, and machine-based, lever driven corkscrews.

Improper storage of wine bottles may cause the corks to become dry and friable. The removal of damaged, dry, broken or otherwise defective corks has not been possible with any of the discussed prior art cork removal devices. A friable, or otherwise defective cork, may crumble and break during removal attempts using the prior art devices. A broken section of the cork may remain lodged within the neck of the bottle and may not be retrieved with the prior art corkscrew. The user may try to push the broken section through the neck in order to pour the liquid trapped in the bottle. Bits of broken cork may be floating in the liquid making it unpalatable or unsuitable for drinking.

Another problem with prior art cork removal devices is the downwardly extending pressure that is typically applied to the cork during removal. The downward pressure may cause a cork to be pushed downwardly through the neck of the bottle where it remains out of reach floating in the liquid.

One prior art method used to remove floating corks is a long, three-fingered device designed to entrap the floating cork for removal. Such a device does not retrieve bits of cork, and the size of the device makes it somewhat impractical for use.

As can be seen from the discussion of the prior art, an unsolved need exists for a device that will enable the removal of broken corks from the neck of a bottle, and will also retrieve a cork or cork section that has been pushed through the neck of a bottle.

SUMMARY OF THE INVENTION WITH OBJECTS

A general object of the present invention is to provide a cork removal device that overcomes the limitations and drawbacks of the prior art.

A specific object of the present invention is to provide a wine cork removal device made from materials that comply with regulations for direct food contact, such as USDA, FDA and Food Additive Regulations.

Another specific object of the present invention is to provide a cork removal device made from a resilient plastic material, such as polyethylene, polypropylene, Teflon (tm), and ultra-high molecular weight plastics.

One more specific object of the present invention is to provide a cork removal device for wine bottles enabling the removal of broken and damaged corks that are lodged in the neck of filled wine bottles.

Yet another specific object of the present invention is to provide a cork removal device for wine bottles enabling the retrieval of a cork or a broken cork that has been pushed through the neck of a filled wine bottle during removal attempts.

Still one more specific object of the present invention is to provide a cork removal device for filled wine bottles enabling the removal of a non-defective cork as well as the retrieval of a damaged cork and cork fragments, and the retrieval of a cork or a broken cork that has been pushed through the neck of the wine bottle.

Yet one more specific object of the invention is to provide a cork removal device constructed from a resilient, food-safe material, the material having a yield point and a modulus of elasticity such that, when the device is placed within the neck of a bottle, the user is able to apply enough force to push a lodged cork section downwardly through the neck of the bottle for subsequent retrieval, and the user is able to apply enough force to pull a retrieved cork upwardly through the neck of a bottle.

In accordance with the principles of the present invention, a cork removal device is provided having a handle, a conventional corkscrew device (such as a spiral corkscrew), and a strap for removal of damaged and pushed-through corks. Both ends of the strap are attached to the handle thereby creating a loop for retrieval operations. The strap is made from a foldable, resilient plastic material, preferably polyethylene or Teflon (tm), and a plurality of transverse creases are formed in the long sides of the loop. The strap is preferably textured or patterned. In its folded position along the creases, the position that is also used to push a broken, lodged cork through the neck of a wine bottle, the middle area of the loop is folded inwardly and upwardly thereby forming the strap into a roughly "W" shaped configuration with the creases forming the bottom of the legs of the "W". The strap is unfolded for retrieval operations. A storage cover is provided for placement over the folded strap. The corkscrew pivots or swings out of the handle for normal cork removal operations.

In one more aspect of the present invention the strap is removably attached to the handle and is therefore replaceable.

In another aspect of the present invention, the strap may be stored within the handle.

In yet another aspect of the present invention, the corkscrew may be omitted.

In yet one more aspect of the present invention, the prefolds in the strap are omitted.

The cork removal device is used as follows: To retrieve a cork or a section of a broken cork floating at the top of the liquid level in a bottle, the strap is unfolded into a loop. The bottom of the loop is pulled downwardly forming an elongated tetrahedron with a saddle in the lower middle section of the strap which is then inserted into the bottle neck.

The user pushes downwardly and the sides of the bottle guide the resilient strap downwardly. The creases in the sides of the strap contact the sides of the bottle thereby facilitating insertion and providing rigidity for positioning of the strap for cork retrieval. As the saddle at the bottom of the strap passes through the neck of the bottle, the saddle touches the cork and deflects it slightly downwardly. When the buoyant cork or cork section bobs up to the top of the liquid level, it is aligned axially with the sides of the bottle and it comes to rest in the saddle of the strap. The user pulls up on the handle and the bottom of the cork is supported in the saddle of the strap. The cork is pulled upwardly while holding the bottle down thereby removing the cork from the bottle.

Broken sections of cork that are lodged in the neck of the filled bottle are retrieved as follows: The strap is used in its folded position, and the two legs of the generally "W" shaped strap are inserted into the top of the bottle. The user pushes downwardly on the handle and the folded strap moves downwardly until the legs contact the lodged cork. The sides of the bottle limit the horizontal movement of the strap within the neck of the bottle as longitudinal force is applied by the user. The rigidity of the material of the strap is sufficient, in combination with the limited horizontal movement, to permit the user to apply enough force to push the lodged cork through the neck. The user then removes the device from the bottle, unfolds the strap into its loop configuration, and uses the device as described above to retrieve the cork section which is now floating at the top of the liquid level.

The plastic strap is preferably textured or patterned so that it acts as an attractant for any cork fragments floating on the surface of the wine. The fragments adhere to the strap and are removed from the bottle.

These and other objects, aspects, advantages and features of the present invention will be more fully understood and appreciated upon consideration of the following detailed description of preferred embodiments, presented in conjunction with accompanying drawings.

DESCRIPTION OF A PREFERRED EMBODIMENT

Figure 1:
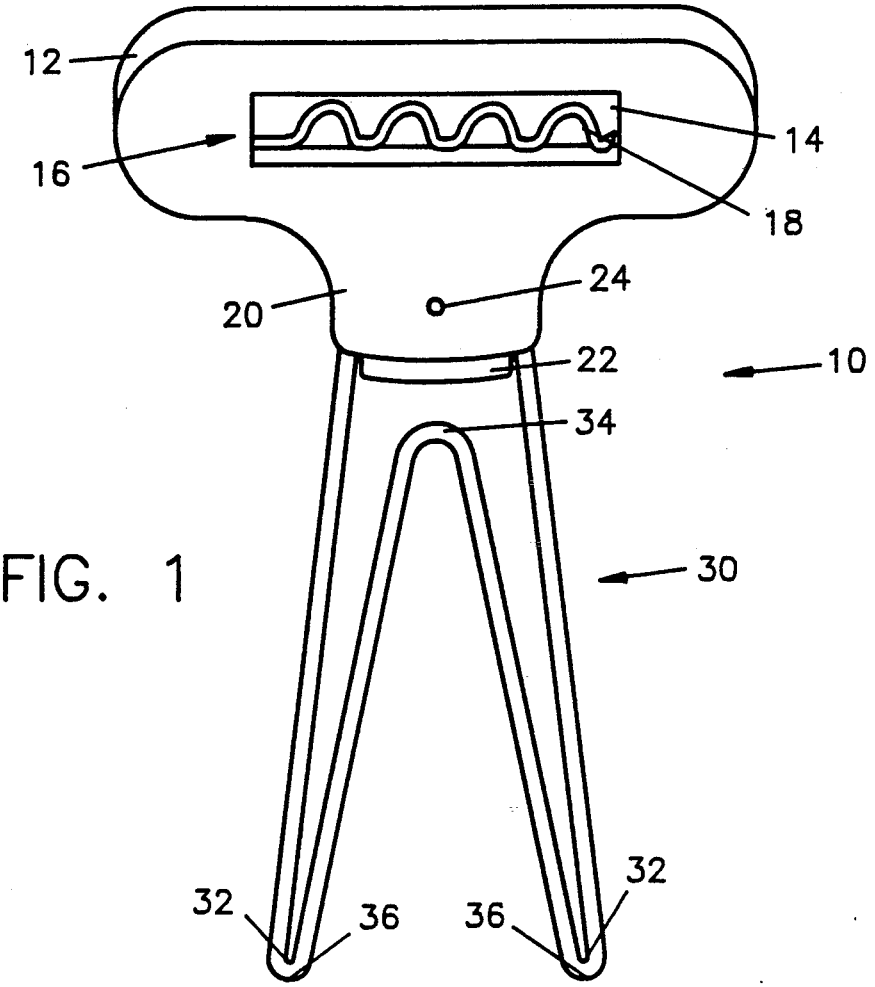
FIG. 1 is a front view of a preferred embodiment of the cork removal device of the present invention showing the folded position of the strap and a fold-out corkscrew in a recess of the handle.
Figure 2:
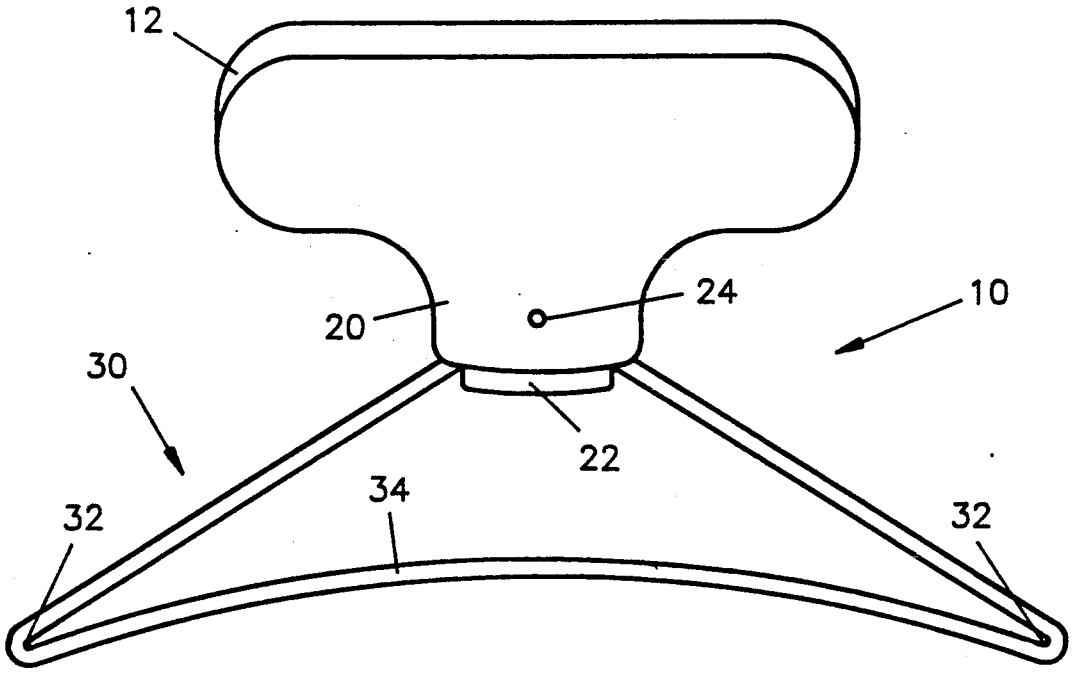
FIG. 2 is a front view of the device of FIG. 1 showing the unfolded position of the strap.

Referring to FIGS. 1 and 2, a preferred embodiment of the cork removal device of the present invention is shown generally at 10. A handle 12 is provided having a recess 14 for a cork extraction member, in this case, a conventional spiral, stainless steel corkscrew 16 having a pointed end 18. The corkscrew 16 pivots or folds outward when in use to remove a cork. The handle may be constructed from stainless steel, other metallic elements or alloys, plastic materials, or wood Stainless steel and other dishwasher safe materials are preferred.

The handle 12 includes a hollow base 20. An insert 22 slides within the hollow base 20 and is secured within the base 20 with a rivet 24, or with other suitable fastening devices.

A strap 30 is attached to the handle 12. The strap is made from a resilient food safe material that preferably complies with regulations of the USDA and FDA for direct food contact. Such materials are generally chemically resistant, non-staining and non-toxic. Plastic materials such as Teflon (tm) and polyethylene are preferred, and polyethylene is economically preferred. Such plastics are strong and resilient, thermoplastic, heat-resistant, and have sufficient tensile strength and modulii of elasticity to withstand the stress and strain caused by the compressing action of forcing a cork downwardly through a bottle neck and the expanding action of pulling a cork upwardly out of a bottle neck. In addition, such plastics do not absorb moisture and are nonstaining. An ultra-high molecular weight plastic, preferably polyethylene, is particularly suitable for the strap 30. The strap 30 may also be made from the same plastic as that used for the construction of champagne corks. Other suitable plastics and material, such as dishwasher safe DELCRON (TM), may also be used. During manufacture, the polyethylene is preferably rolled to form a strap which is then stamped with a pattern, such as the pattern shown in FIG. 10. The strap is placed over the insert 22 prior to placement of the insert 22 into the hollow base 20.

The strap is shown in its folded position in FIG. 1, and its unfolded loop position in FIG. 2. A transverse crease 32 is pre-formed in each long side of the strap. The creases cause the bowed out shape of the resilient strap in its unfolded loop position. To assume the folded position shown in FIG. 1, the bottom middle portion 34 of the strap is folded inwardly and upwardly causing the strap to assume a roughly "W" shape with the creases 32 forming the bottom of the legs 36 of the "W". The folded position is used for storage of the device and for pushing broken, lodged corks through the neck of the bottles.

Figure 3C:
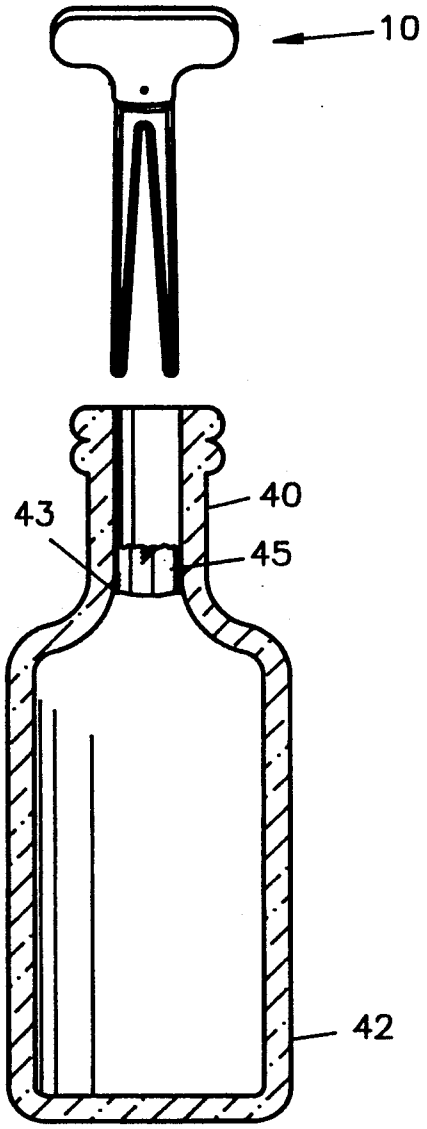
FIGS. 3A–3C are front views of bottles having corks floating at the top of the liquid and broken and lodged within the neck of the bottle, and also showing two cork retrieval devices above two of the bottles, the cork retrieval devices in the folded and the unfolded tetrahedon configuration prior to insertion within the necks of the bottles.
Figure 3B:
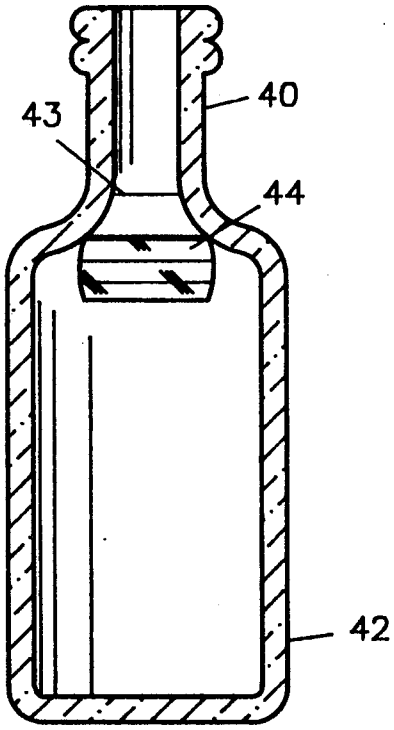
Figure 3A:
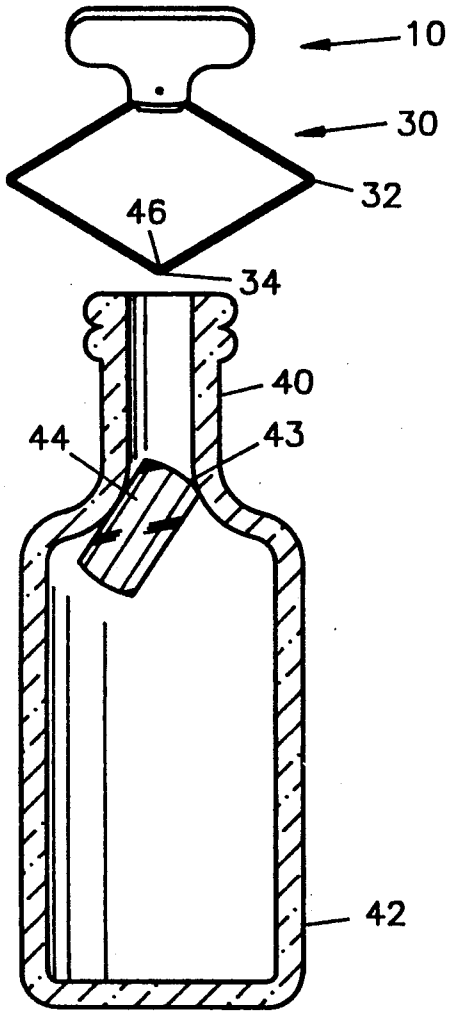

Referring now to FIGS. 3A-3C, the cork removal device 10 is shown positioned above the neck 40 of a bottle 42 having a liquid level 43. FIGS. 3A and 3B show several positions of corks 44 that have been pushed through the neck 40 of the bottle 42 and are floating at the top of the liquid in the bottle. The buoyant cork 44 may be aligned axially with the curved sides of the bottle as shown in FIG. 3A, or the cork 44 may be aligned across the neck 40 of the bottle 42 as shown in FIG. 3B. FIG. 3C shows the cork removal device 10 in its folded position prior to its insertion into the bottle neck 40 to push a broken cork 45 through the neck 40 for retrieval. In FIG. 3A, middle section 34 of strap 30 has been pulled downwardly forming an elongated tetrahedron having a saddle portion 46 which may be inserted into the neck 40 of the bottle 42.

Figure 4:
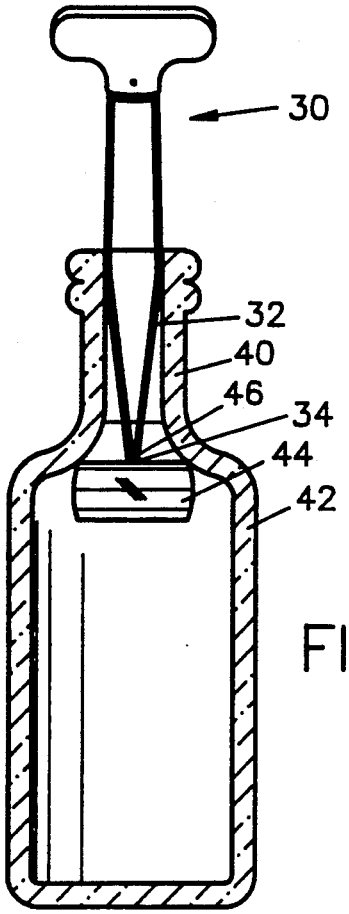
FIG. 4 is a front view showing the strap partially inserted into a bottle neck with the creases contacting the sides of the bottle neck.

Referring now to FIGS. 4 through 7, a method is shown for removing a cork 44 that has been pushed through the neck 40 of the bottle 42 and is floating at the top of the liquid level 43. In FIG. 4, the cork removal device 10 is shown partially inserted into the neck 40. The creases 32 are contacting the sides of the neck 40 of the bottle. This contact between the creases 32 and the sides of the neck 40 enables the strap 30 to be guided downwardly along the sides of the neck 40 and further provides rigidity for positioning the strap 30 for retrieval of the cork 44.

Figure 5:
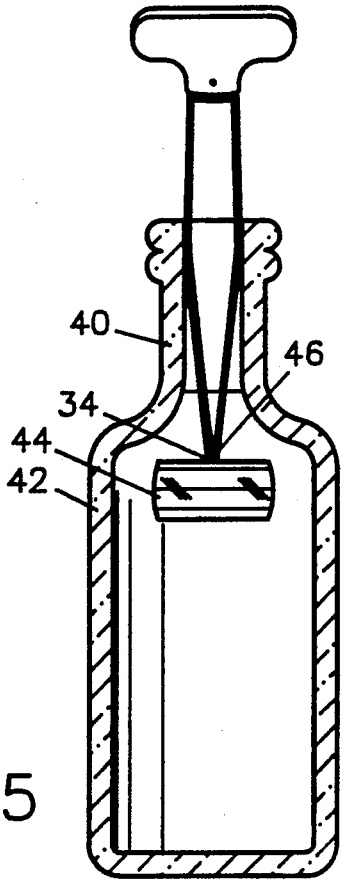
FIG. 5 is a front view showing the strap extending through the neck of the bottle and in contact with a cork which is being forced downwardly.
Figure 6:
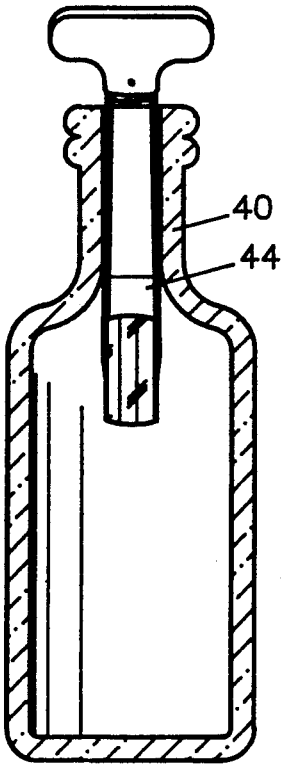
FIG. 6 is a front view showing the buoyant cork resting in the saddle of the strap.
Figure 7:
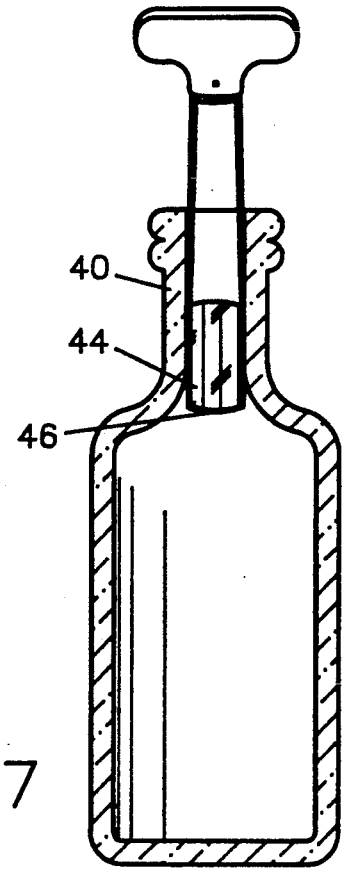
FIG. 7 is a front view showing the position of the cork in the saddle as upward movement is begun to remove the cork.

Referring now to FIG. 5, the strap 30 has been lowered until the saddle portion 46 has contacted the cork 44 and deflected it downwardly. As device 10 is moved to its lowest position, as shown in FIG. 6, it is preferably to twist the handle slightly. The buoyancy of the cork causes it to bob upwardly to the top of the liquid level and to axially aligned itself with the sides of the bottle where it comes to rest in the saddle 46 of the strap. As the user pulls upwardly on the handle 12, the device 10 is pulled upwardly, FIG. 7, and the buoyant cork 44 is raised with the strap. The bottom of the cork is supported in the saddle 46 during removal.

Broken sections of cork, shown in FIG. 3C, are removed as described above after hey have been pushed through the neck of the bottle by device 10 in its folded position. The two legs formed by the creases 32 of the generally "W" shaped, folded strap are inserted into the top of the bottle. The user pushes downwardly on the handle 12 and the folded strap moves downwardly until the legs contact the lodged cork. The sides of the bottle limit the horizontal movement of the strap within the neck of the bottle as longitudinal force is applied by the user. The rigidity of the material of the strap is sufficient, in combination with the limited horizontal movement, to permit the user to apply enough compressive force to push the lodged cork through the neck.

Figure 10:
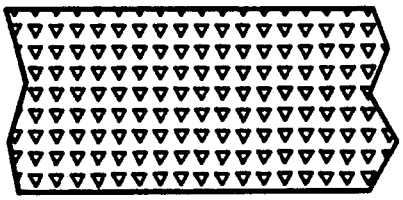
FIG. 10 shows a top view of a section of a polyethylene strap showing the pattern.

The pattern in the strap, FIG. 10, creates additional surface area on the strap and acts as an attractant for any cork fragments floating on the surface of the liquid. The fragments adhere to the patterned strap and are removed during retrieval operations.

The strap 30 of the cork removal device 10 is approximately 3 inches in length in its folded position and 5 inches in length in its unfolded loop position thereby enabling removal of corks from most wine bottles in the manner described. A longer strap, approximately 8 to 9 inches may be provided for bottles with longer necks, such as resiling wine bottles. The device 10 is suitable for removing floating corks in any alignment. Once the buoyant cork has been pushed downwardly and the handle twisted to cause the middle section 34 to shift its position on the cork 44, the cork's natural buoyancy causes it to move upwardly following the curve of the bottle and into the saddle 46 of the device 10. A slight twist of the handle may be necessary to position the cork for removal.

Figure 8A:
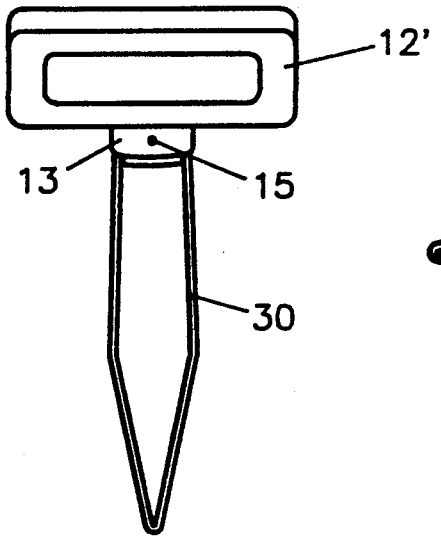
FIGS. 8A–8C are views of various handle aspects of the cork removal device.
Figure 8B:
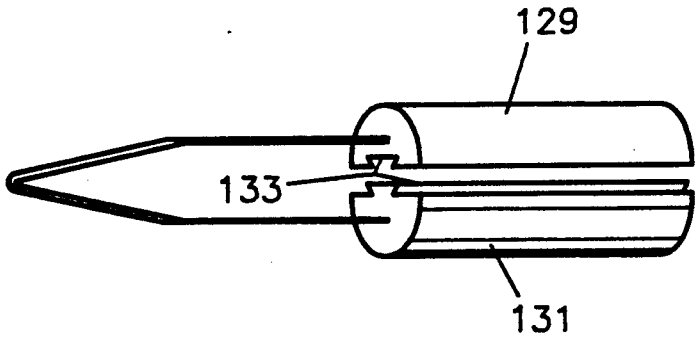
Figure 8C:
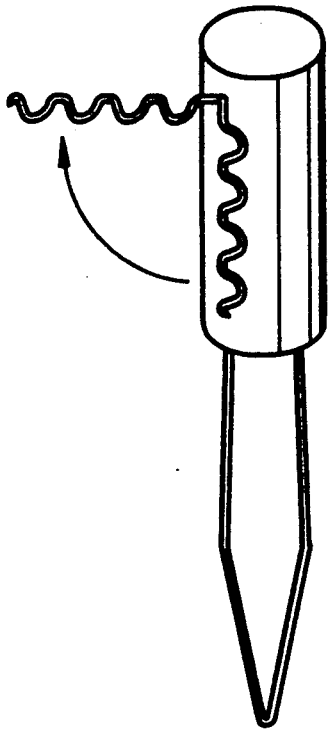
Figure 9:
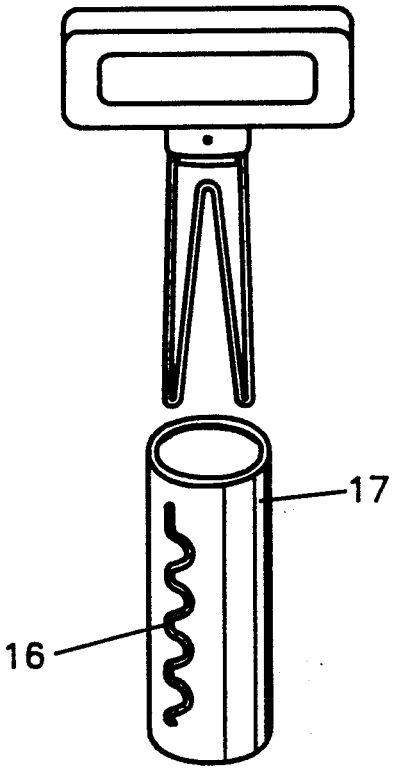
FIG. 9 shows a cover having a fold out corkscrew, the cover for placement over the folded strap for storage.

Referring now to FIGS. 8A-8C, aspects of the handle 12 are shown. FIG. 8A shows an open handle 12' having the strap attached through the open section of the handle and secured with a clamping device 13 and a pin 15. In this aspect, a cover 17 for the strap, shown in FIG. 9, may be provided with a fold out corkscrew 17. FIG. 8B shows a generally circular handle having two sections 129 and 131 that are joined together by a tongue and groove joint 133 to form the handle shown in FIG. 8C. A flexible material is used for the strap in FIG. 8B, and the pre-formed creases are eliminated.

Figure 11A:
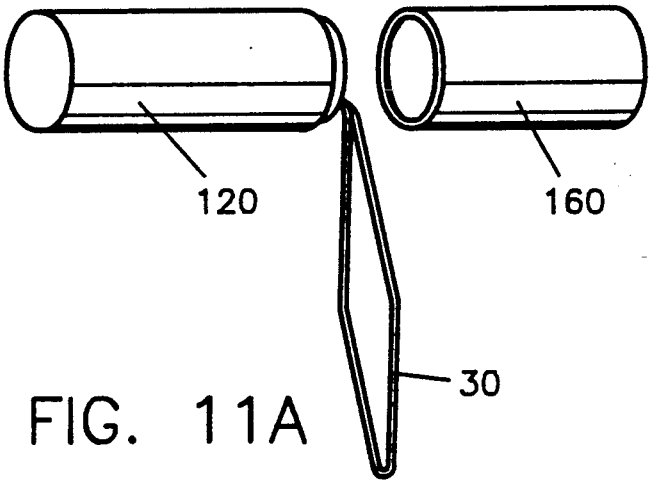
FIGS. 11A–11C are perspective views of aspects of the device where the strap is stored within the handle.
Figure 11B:
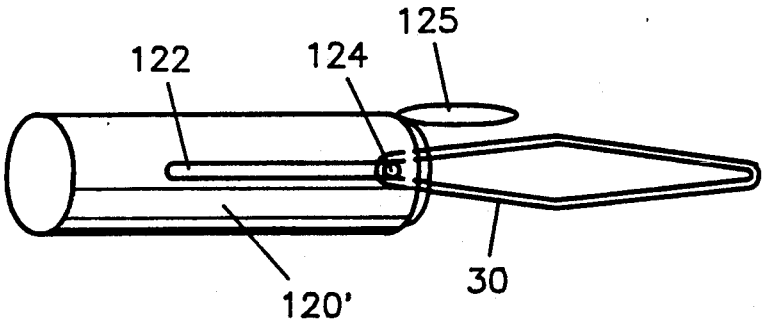
Figure 11C:
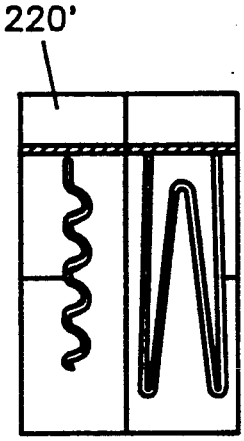

FIGS. 11A and 11B show a generally circular hollow handle 120 that holds strap 30. A cover 160 may be provided, or as shown in FIG. 11B, the end of the handle 125 may be removed or flip upwardly for access to the strap 30. FIG. 11B also shows a slot 122 in the handle 120'. The strap 30 is secured to a pin 124 which slides back and forth in the slot 122. FIG. 11C shows a front view of double-compartmented handle 220' containing the cork screw within one compartment and the strap within the other compartment. A pull-off cover is provided.

The apparatus and method shown and described herein are illustrative of the principle of the invention and are not meant to be limiting of its scope. For instance, it will be recognized by those skilled in the art that other plastic materials may be used to form the strap such as resin plastics, cellulose plastics, nylon plastics, and cast plastics. In addition, strapping materials or coated cords may be used. The strap and handle may be provided as a unit thereby omitting the conventional corkscrew. The conventional cork remover, when provided, may be an "AH SO" prong device or a lever device. A variety of patterns may be used to configure the strap material. Other materials and designs may be used for the handle, and the handle may be decorated or formed into decorative shapes.

It will also be recognized by those skilled in the art that while the device may be used to push a variety of stoppers through the necks of filled or empty bottles, only buoyant stoppers may be removed from the bottles with the strap, and the bottles must contain sufficient liquid so that the buoyant stoppers will be reached by the strap. If desired, liquid may be added to the bottle for removal of a buoyant stopper.

Various other embodiments will be apparent to those skilled in the art and may be made without departing from the spirit and scope of the invention as defined by the following claims.

I claim:

1. A device for removing a stopper from a container, the container having a neck and a liquid containing portion below the neck, the liquid containing portion having a liquid level therein, the device comprising:

a handle means; and a strap means made from a resilient material and attached to the handle means, the strap means having a first folded position for pushing the stopper through the neck into the liquid containing portion, and having a second unfolded position for removing the stopper from the liquid containing portion, the resilient material having at least one permanent crease and having a modulus of elasticity sufficient, in combination with the dimensions of the neck of the container, to withstand the compressive forces necessary to force a lodged stopper through the neck of the container into the liquid.

2. A device for removing a cork from a bottle having a neck and a lower portion having a predetermined amount of liquid therein, the device comprising:

a handle means; and a strap of resilient polymeric material removable affixed to the handle, the strap forming a closed loop when attached to the handle and having at least two pre-formed creases, the creases for pushing against the cork to force the cork through the neck of the bottle when the strap is configured in a first folded position, and for guiding and positioning the strap to remove the cork from the liquid in the lower portion when the strap is unfolded to form a saddle portion in a second retrieval position.

3. The device of claim 2 wherein the resilient strap has a modulus of elasticity sufficient to withstand the expansion forces necessary for the user to pull with the stopper upwardly through the neck of the container and, in combination with the dimensions of the neck of the container, sufficient to withstand the compressive forces necessary to force the stopper through the neck of the container into the liquid.

4. The device of claim 2 wherein at least a portion of the resilient strap defines a patterned surface for the adherence of at least one fragment of the stopper.

5. The device of claim 2 wherein the resilient strap is made of a food safe polymeric material.

6. The device of claim 5 wherein the resilient strap is made of a polymeric material selected from the group consisting polyethylene, ultra-high molecular weight plastics, Teflon TM plastics, cast plastics, polypropylene, and cast acrylic plastics.

7. The device of claim 2 wherein the strap is generally "W"-shaped in the folded position and generally an elongated tetrahedron shape in the second position, the tetrahedron shape occurring when a middle region of the "W" is pulled downwardly to form the saddle portion.

8. The device of claim 2 wherein the handle means comprises means for removably attaching the strap means.

9. The device of claim 2 further comprising a conventional stopper remover element.

10. The device of claim 2 further comprising a cover means for storing the device.

11. A method for removing a cork from the neck of a bottle having a predetermined liquid level, the cork having been damaged or pushed downwardly past the reach of a conventional cork removal device, the method using a cork removal device having a strap attached to a handle, the strap made from a material having a modulus of elasticity sufficient to withstand the expansion forces necessary for pulling the cork upwardly through the neck of the bottle and, in combination with the dimensions of the neck of the bottle, sufficient to withstand the compressive forces necessary to force the cork through the neck of the bottle into the liquid, the strap having a first folded position and a second unfolded position, the method comprising the steps of:

inserting the strap in the folded position into the neck of the bottle until two creases in the folded strap contact the cork;

applying a downward compressive force on the handle so that the creases push against the cork thereby forcing the cork through the neck of the container to float in the liquid;

pulling upwardly on the handle to remove the device from the neck of the bottle;

unfolding the strap into its second position by pulling downwardly on a saddle portion thereof;

inserting the saddle portion of the strap into the neck of the bottle;

pushing downwardly on the handle to lower the unfolded strap through the neck of the bottle;

using the creases touching the neck of the bottle to guide and position the strap until the saddle portion touches the cork floating in the liquid;

continuing downward pressure on the handle to deflect the cork until the saddle portion is positioned just beyond the bottom of the neck of the bottle;

twisting the handle until the cork floats upwardly into the saddle portion; and pulling upwardly on the handle while applying downward force to the bottle to remove the cork captured within the saddle portion.

* * * * *